US008093816B2

(12) United States Patent
Hayashi

(10) Patent No.: US 8,093,816 B2
(45) Date of Patent: Jan. 10, 2012

(54) COLD CATHODE TUBE LAMP

(75) Inventor: Keiji Hayashi, Kameyama (JP)

(73) Assignee: Sharp Kabushiki Kaisha, Osaka (JP)

( * ) Notice: Subject to any disclaimer, the term of this patent is extended or adjusted under 35 U.S.C. 154(b) by 315 days.

(21) Appl. No.: 12/513,295

(22) PCT Filed: Jul. 27, 2007

(86) PCT No.: PCT/JP2007/064744

§ 371 (c)(1),
(2), (4) Date: May 1, 2009

(87) PCT Pub. No.: WO2008/056471

PCT Pub. Date: May 15, 2008

(65) Prior Publication Data

US 2010/0109544 A1 May 6, 2010

(30) Foreign Application Priority Data

Nov. 9, 2006 (JP) ..... 2006-303490

(51) Int. Cl.

| | |
|---|---|
| ***H01J 7/44*** | (2006.01) |
| ***H01J 13/46*** | (2006.01) |
| ***H01J 17/34*** | (2006.01) |
| ***H01J 19/78*** | (2006.01) |
| ***H01J 23/16*** | (2006.01) |
| ***H01J 29/96*** | (2006.01) |
| ***H01K 1/62*** | (2006.01) |

(52) U.S. Cl. ..... 315/32; 315/59; 315/241 R; 315/309

(58) Field of Classification Search ..... 315/53, 315/59, 227 R, 241 R, 244, 282, 309, DIG. 5
See application file for complete search history.

(56) References Cited

U.S. PATENT DOCUMENTS 4,134,042 A * 1/1979 van Heemskerck Veeckens ..... 315/59
5,019,749 A * 5/1991 Ito ..... 315/224

FOREIGN PATENT DOCUMENTS

| | | |
|---|---|---|
| JP | 2-41362 U | 3/1990 |
| JP | 5-1199 U | 1/1993 |
| JP | 5-61998 U | 8/1993 |
| JP | 10-177170 A | 6/1998 |

* cited by examiner

*Primary Examiner* — Anh Tran
(74) *Attorney, Agent, or Firm* — Birch, Stewart, Kolasch & Birch, LLP

(57) ABSTRACT

A cold cathode tube lamp which can be lighted easily when the ambient temperature is low. The cold cathode tube lamp comprises discharge tubes having a pair of electrodes and being driven when a voltage having an AC component is supplied thereto, and ballast capacitors connected with at least one of the pair of electrodes. The ballast capacitor is arranged to come into thermal contact with the discharge tube and to increase the capacitance as the surface temperature of the ballast capacitor decreases.

6 Claims, 5 Drawing Sheets

COLD CATHODE TUBE LAMP

TECHNICAL FIELD

The present invention relates to a cold cathode tube lamp. More particularly, the invention relates to a cold cathode tube lamp provided with a ballast capacitor.

BACKGROUND ART

Conventionally, cold cathode tube lamps are used as light sources for various devices. For example, conventionally, there are known cold cathode tube lamps that can be used as light sources (backlights) for liquid crystal display devices.

The conventional cold cathode tube lamp is, in terms of an equivalent circuit, a resistor whose resistance decreases nonlinearly as current increases and has a nonlinear negative impedance characteristic like the V-I characteristic shown in FIG. 8. Thus, when an attempt is made to drive a plurality of cold cathode tube lamps connected in parallel, there arises the following problem. That is, when an attempt is made to drive a plurality of cold cathode tube lamps connected in parallel, after the voltage across one predetermined cold cathode tube lamp reaches the withstand voltage (the voltage that causes insulation breakdown), the voltage across that one predetermined cold cathode tube lamp decreases owing to the nonlinear negative impedance characteristic. Here, the voltage across the other cold cathode tube lamps is equal to the voltage across the one predetermined cold cathode tube lamp, and thus the voltage across the other cold cathode tube lamps does not reach the withstand voltage. This makes it difficult to light all of the cold cathode tube lamps.

To solve the problem just described, one way is to connect separate inverter power supplies one to each of the plurality of cold cathode tube lamps. This, however, leads to disadvantages such as increased sizes of backlights.

Thus, a cold cathode tube lamp having a ballast capacitor connected to a discharge tube is conventionally proposed (for example, see Patent Document 1). According to Patent Document 1, the equivalent circuit has a capacitor connected to a resistor of which the resistance decreases nonlinearly as current increases, and thus has a nonlinear positive impedance characteristic like the V-I characteristic shown in FIG. 9. Thus, according to Patent Document 1, when a plurality of cold cathode tube lamps connected in parallel are driven, all of the cold cathode tube lamps can be lit.

Patent Document 1: JP-A-10-177170 Publication

DISCLOSURE OF THE INVENTION

Problems to be Solved by the Invention

The lighting of a conventional cold cathode tube lamp is achieved by supplying power across a discharge tube that has rare gas and mercury vapor sealed in it and thereby causing discharge. Here, it is known that, when the ambient temperature around the discharge tube is low, the mercury vapor pressure inside the discharge tube is low, and thus the withstand voltage is high. On the other hand, the open-circuit voltage of an inverter power supply and the capacitance of a ballast capacitor are approximately constant, regardless of the environment temperature. Thus, conventionally, if an attempt is made to light a cold cathode tube lamp when the ambient temperature around the discharge tube is low, the voltage across the discharge tube may be lower than the withstand voltage, which makes the lighting of the cold cathode tube lamp difficult.

The present invention is devised to solve the problem described above, and an object of the invention is to provide a cold cathode tube lamp that can be lit easily when the ambient temperature around a discharge tube is low.

Means for Solving the Problem

To achieve the above object, according to a first aspect of the present invention, a cold cathode tube lamp includes a discharge tube that has a pair of electrodes and is driven by being supplied with a voltage containing an AC component, and a ballast capacitor connected to at least one of the electrodes of the discharge tube. The ballast capacitor is in thermal contact with the discharge tube and is configured such that its capacitance increases as the surface temperature of the ballast capacitor decreases. What is referred to as "thermal contact" in the present invention means thermal contact with no air present in between.

In the cold cathode tube lamp according to the first aspect, as described above, by keeping the ballast capacitor, connected to at least one of the electrodes of the discharge tube, in thermal contact with the discharge tube, it is possible to decrease the surface temperature of the ballast capacitor as the ambient temperature around the discharge tube decreases. In this case, by configuring the ballast capacitor described above such that its capacitance increases as the surface temperature of the ballast capacitor decreases, since the capacitance of the ballast capacitor then increases as the ambient temperature around the discharge tube decreases, it is possible to decrease the impedance of the ballast capacitor as the ambient temperature around the discharge tube decreases. Thus, owing to the voltage drop in the ballast capacitor being in proportion to the impedance of the ballast capacitor, it is possible to decrease the voltage drop in the ballast capacitor as the ambient temperature around the discharge tube decreases. That is, it is possible to increase the potential difference between the pair of electrodes of the discharge tube as the ambient temperature around the discharge tube decreases. This makes it possible, even when the withstand voltage (the voltage that causes insulation breakdown) increases as the ambient temperature around the discharge tube decreases, to prevent the potential difference between the pair of electrodes of the discharge tube from becoming smaller than the withstand voltage. As a result, it is possible to light the cold cathode tube lamps easily when the ambient temperature around the discharge tube is low.

In the cold cathode tube lamp according to the above-described first aspect, preferably, at least part of the ballast capacitor is in direct thermal contact with the discharge tube. With this structure, it is possible to reliably increase the capacitance (i.e. to reduce the impedance) of the ballast capacitor as the ambient temperature around the discharge tube decreases.

In this case, preferably, the ballast capacitor is provided integrally with the discharge tube. With this structure, it is possible to keep the ballast capacitor in direct thermal contact with the discharge tube easily.

In the above-described structure where the ballast capacitor is provided integrally with the discharge tube, preferably, the ballast capacitor includes a conductive layer and a dielectric layer, and the conductive layer and the dielectric layer are provided integrally with the discharge tube by being directly applied on the surface of the discharge tube. With this structure, it is possible to let the surface temperature of the ballast capacitor reliably follow variations in the ambient temperature around the discharge tube.

In the cold cathode tube lamp according to the above-described first aspect, preferably, a heat-conductive member that is disposed between the discharge tube and the ballast capacitor is further included and the ballast capacitor is in thermal contact with the discharge tube indirectly via the heat-conductive member. With this structure, it is possible to increase the capacitance (i.e. to reduce the impedance) of the ballast capacitor as the ambient temperature around the discharge tube decreases even when the ballast capacitor is not in direct thermal contact with the discharge tube. Moreover, with the above structure, because there is no need to provide the ballast capacitor integrally with the discharge tube, the discharge tube can be replaced solely.

In this case, preferably, a circuit board on which the ballast capacitor is mounted is further included. With this structure, it is possible to hold the ballast capacitor easily with the circuit board when the ballast capacitor is not provided integrally with the discharge tube. Moreover, it is possible to stabilize the electrical connection between the ballast capacitor and the circuit board (e.g. inverter board, etc.).

Advantages of the Invention

As described above, according to the present invention, it is possible to obtain a cold cathode tube lamp that can be lit easily when the ambient temperature around a discharge tube is low.

LIST OF REFERENCE SYMBOLS

1, 40 Discharge tube
2, 3, 50, 60 Ballast capacitor
12, 13, 42, 43 Electrode
21, 31 Internal electrode (conductive layer)
22, 32 External electrode (conductive layer)
23, 33 Dielectric layer
54, 64 Heat-conductive member
70 Inverter board (circuit board)

BEST MODE FOR CARRYING OUT THE INVENTION

First Embodiment

First, the structure of a cold cathode tube lamp according to a first embodiment of the present invention will be described with reference to FIGS. 1 and 2.

Figure 1:
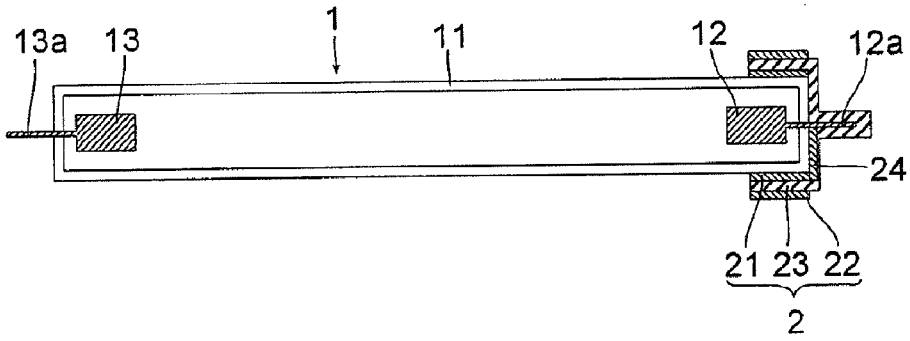
[FIG. 1] A schematic sectional view showing the structure of a cold cathode tube lamp according to a first embodiment of the present invention.
Figure 2:
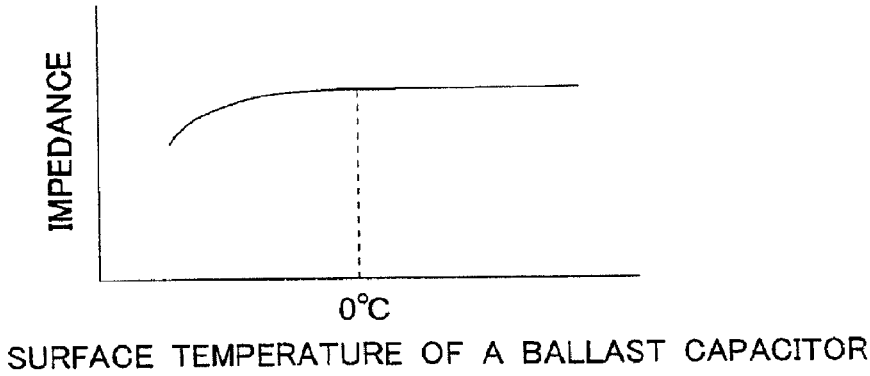
[FIG. 2] A diagram showing the relationship between the surface temperature and the impedance of a ballast capacitor of the cold cathode tube lamp according to the first embodiment shown in FIG. 1.

The cold cathode tube lamp according to the first embodiment includes, as shown in FIG. 1, a discharge tube 1 that is driven by being supplied with a voltage containing an AC component. This discharge tube 1 is composed of a sealed tubular glass tube (insulating tube) 11 and a pair of electrodes 12 and 13 provided inside the glass tube 11. Note that, though not shown, a fluorescent substance is applied on the inner wall surface of the glass tube 11, and rare gas (a mixed gas of Ne and Ar) and mercury vapor are sealed in the glass tube 11. The electrodes 12 and 13 are disposed in one and the other end parts, respectively, of the glass tube 11. The electrodes 12 and 13 have leads 12*a* and 13*a*, respectively, that penetrate and protrude from the side end parts of the glass tube 11. The lead 12*a* of one electrode 12 is covered with a dielectric layer 23 of a ballast capacitor 2, which will be described later, such that the surface of the lead 12*a* is not exposed. The lead 13*a* of the other electrode 13 is connected to an unillustrated inverter board.

In the first embodiment, the ballast capacitor 2 is provided at, integrally with, one end part of the discharge tube 1. This ballast capacitor 2 is composed of an internal electrode 21 and an external electrode 22, both made of silver, and the dielectric layer 23, and materials forming the internal electrode 21, the external electrode 22, and the dielectric layer 23, respectively are directly applied on the surface of the discharge tube 1. Note that the internal electrode 21 and the external electrode 22 are examples of a "conductive layer" according to the invention. The internal electrode 21 is, at one end part of the discharge tube 1, directly formed on the outer surface of the discharge tube 1 (glass tube 11). That is, the internal electrode 21 is cylindrical, and is in contact with the discharge tube 1 (glass tube 11). Moreover, the internal electrode 21 is connected to the lead 12*a* of one electrode 12 of the discharge tube 1 via a predetermined conductive member 24. The predetermined conductive member 24 is covered with the dielectric layer 23 of the ballast capacitor 2, such that the surface of the conductive member 24 is not exposed.

In the first embodiment, the internal electrode 21 may be a molded component (a cap-shaped component) made of brass, phosphor bronze, nickel, or another material.

The external electrode 22 of the ballast capacitor 2 is cylindrical, and is so disposed as to face the internal electrode 21 with the dielectric layer 23 interposed in between. This external electrode 22 is connected to the unillustrated inverter board. Thus, power is supplied to one electrode 12 of the discharge tube 1 via the ballast capacitor 2. The dielectric layer 23, which is interposed between the internal electrode 21 and the external electrode 22 of the ballast capacitor 2, is so formed as to extend to the end surface of the discharge tube 1 (glass tube 11), and part of the dielectric layer 23 is in contact with the end surface of the discharge tube 1 (glass tube 11). In the first embodiment, with the structure described above, at least part of the ballast capacitor 2 is in direct thermal contact with the discharge tube 1.

In the first embodiment, the dielectric layer 23 of the ballast capacitor 2 is made of a material based on strontium titanate ($StTiO_2$). Note that, in terms of its properties, strontium titanate has a relative dielectric constant of approximately 300 and a dielectric constant temperature coefficient of approximately −300 ppm/K. In the ballast capacitor 2 employing the dielectric layer 23 made of such a material, when the surface temperature of the ballast capacitor 2 is below approximately 0° C., the capacitance increases as the surface temperature of the ballast capacitor 2 decreases. Specifically, when the surface temperature of the ballast capacitor 2 is below approximately 0° C., the capacitance of the ballast capacitor 2 increases by approximately 5% to approximately 10% as the surface temperature of the ballast capacitor 2 decreases by approximately 10° C. Thus, as shown in FIG. 2, when the surface temperature of the ballast capacitor 2 is below approximately 0° C., the impedance of the ballast capacitor 2 decreases as the surface temperature of the ballast capacitor 2 decreases. Note that when the surface temperature of the ballast capacitor 2 is above approximately 0° C., the impedance of the ballast capacitor 2 is approximately constant.

Next, with reference to FIGS. 1 to 4, a description will be given of the potentials at positions A to D at the time of lighting of the cold cathode tube lamp according to the first embodiment.

In the cold cathode tube lamp according to the first embodiment shown in FIG. 1, its lighting is achieved when the lamp voltage (the potential difference between the electrodes 12 and 13) becomes larger than the withstand voltage (the voltage that causes insulation breakdown) and discharge starts in the glass tube 11. Specifically, when discharge starts in the glass tube 11, ultraviolet rays are emitted by the collision of electrons with mercury atoms. Then, a fluorescent substance absorbs the ultraviolet rays and is excited to emit light.

Here, when the ambient temperature around the discharge tube 1 is below approximately 0° C., the mercury vapor pressure inside the glass tube 11 is low, and thus the withstand voltage is high. That is, to light the cold cathode tube lamp in a case where the ambient temperature around the discharge tube 1 is below approximately 0° C., the lamp voltage needs to be larger than that in a case where the ambient temperature around the discharge tube 1 is above approximately 0° C.

Figure 3:
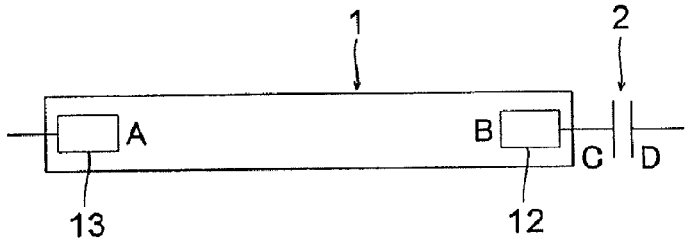
[FIG. 3] An equivalent circuit diagram of the cold cathode tube lamp according to the first embodiment shown in FIG. 1.
Figure 4:
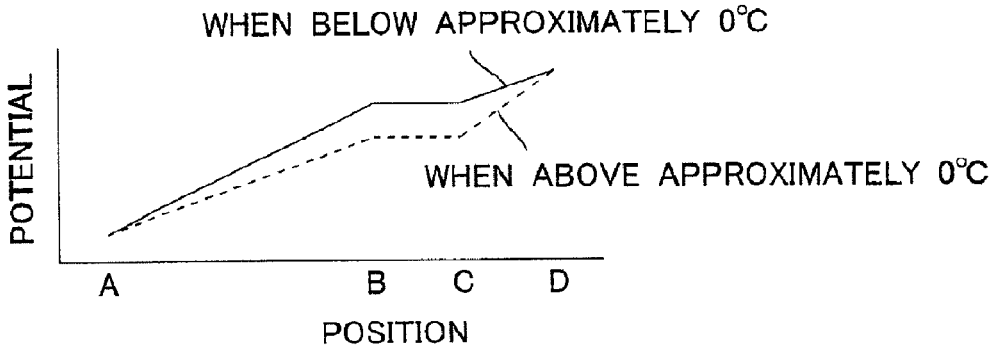
[FIG. 4] A diagram illustrating the potentials at positions A to D shown in FIG. 3.

The ballast capacitor 2 according to the first embodiment is, as shown in FIG. 1, so configured as to be in direct thermal contact with the discharge tube 1. Moreover, the ballast capacitor 2 according to the first embodiment is, as shown in FIG. 2, configured such that when the surface temperature of the ballast capacitor 2 is below approximately 0° C., the impedance of the ballast capacitor 2 decreases as the surface temperature of the ballast capacitor 2 decreases. That is, in the first embodiment, when the ambient temperature around the discharge tube 1 is below approximately 0° C., the impedance of the ballast capacitor 2 decreases as the ambient temperature around the discharge tube 1 decreases. Thus, as shown in FIGS. 3 and 4, the voltage drop between positions C and D (between the internal electrode 21 and the external electrode 22 of the ballast capacitor 2) when the ambient temperature around the discharge tube 1 is below approximately 0° C. decreases as the ambient temperature around the discharge tube 1 decreases. This makes the potential of one electrode 12 (the potential at position B) of the discharge tube 1, connected to the ballast capacitor 2, larger than in a case where the ambient temperature around the discharge tube 1 is above approximately 0° C.

Thus, the lamp voltage in a case where the ambient temperature around the discharge tube 1 is below approximately 0° C. is larger than in a case where the ambient temperature around the discharge tube 1 is above approximately 0° C. Therefore, in the first embodiment, even when the withstand voltage is large as a result of the ambient temperature around the discharge tube 1 being below approximately 0° C., the lamp voltage automatically increases as the ambient temperature around the discharge tube 1 decreases; thus, it is possible to light the cold cathode tube lamp.

In the first embodiment, as described above, by keeping the ballast capacitor 2, connected to one electrode 12 of the discharge tube 1, in thermal contact with the discharge tube 1, it is possible to decrease the surface temperature of the ballast capacitor 2 as the ambient temperature around the discharge tube 1 decreases. In this case, by configuring the ballast capacitor 2 described above such that its capacitance increases as the surface temperature of the ballast capacitor 2 decreases, since the capacitance of the ballast capacitor 2 then increases as the ambient temperature around the discharge tube 1 decreases, it is possible to decrease the impedance of the ballast capacitor 2 as the ambient temperature around the discharge tube 1 decreases. Thus, owing to the voltage drop in the ballast capacitor 2 being in proportion to the impedance of the ballast capacitor 2, it is possible to decrease the voltage drop in the ballast capacitor 2 as the ambient temperature around the discharge tube 1 decreases. That is, it is possible to increase the potential difference between the pair of electrodes (between the electrodes 12 and 13) of the discharge tube 1 as the ambient temperature around the discharge tube 1 decreases. This makes it possible, even when the withstand voltage (the voltage that causes insulation breakdown) increases as the ambient temperature around the discharge tube 1 decreases, to prevent the potential difference between the pair of electrodes (between the electrodes 12 and 13) of the discharge tube 1 from becoming smaller than the withstand voltage. As a result, it is possible to light the cold cathode tube lamps easily when the ambient temperature around the discharge tube 1 is low.

In the first embodiment, by keeping at least part of the ballast capacitor 2 in direct thermal contact with the discharge tube 1 as described above, it is possible to reliably increase the capacitance (i.e. to reduce the impedance) of the ballast capacitor 2 as the ambient temperature around the discharge tube 1 decreases.

In the first embodiment, by providing the ballast capacitor 2 integrally with the discharge tube 1 as described above, it is possible to keep the ballast capacitor 2 in direct thermal contact with the discharge tube 1 easily.

In the first embodiment, by directly applying the internal electrode 21, the external electrode 22, and the dielectric layer 23 that form the ballast capacitor 2 on the surface of the discharge tube 1 as described above, it is possible to let the surface temperature of the ballast capacitor 2 reliably follow variations in the ambient temperature around the discharge tube 1.

The cold cathode tube lamp according to the first embodiment described above can be used as a light source for various devices, such as lighting devices and liquid crystal display devices.

Next, with reference to FIG. 5, a description will be given of a cold cathode tube lamp according to a modified example of the first embodiment.

Figure 5:
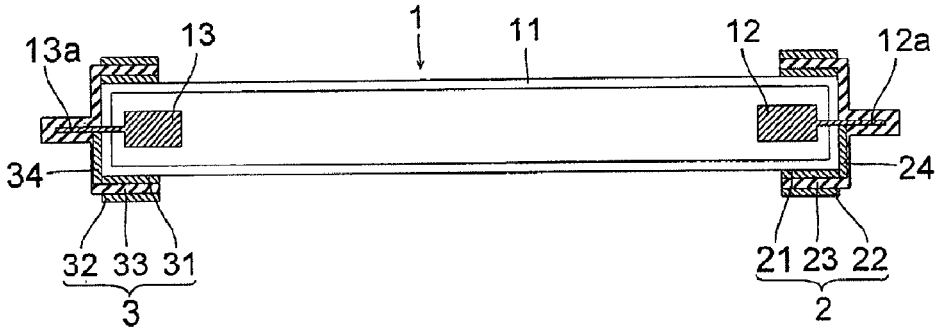
[FIG. 5] A schematic sectional view showing the structure of a cold cathode tube lamp according to a modified example of the first embodiment.

As shown in FIG. 5, compared with the cold cathode tube lamp of the above-described first embodiment, that according to the modified example of the first embodiment differs in that in addition to the ballast capacitor 2 provided at, integrally with, one end part of the discharge tube 1, a ballast capacitor 3 is further provided at, integrally with, the other end part of the discharge tube 1. This ballast capacitor 3, like the ballast capacitor 2, is composed of an internal electrode 31 and an external electrode 32, and a dielectric layer 33. Note that the internal electrode 31 and the external electrode 32 are examples of a "conductive layer" according to the invention.

The internal electrode 31 of the ballast capacitor 3 is connected to a lead 13*a* of the other electrode 13 of the discharge tube 1 via a predetermined conductive member 34. The external electrode 32 of the ballast capacitor 3 is connected to an unillustrated inverter board. In the modified example of the first embodiment, power is supplied to the other electrode 13 of the discharge tube 1 via the ballast capacitor 3.

The ballast capacitor 3, like the ballast capacitor 2, is so configured as to be in direct thermal contact with the discharge tube 1. Moreover, the ballast capacitor 3, like the ballast capacitor 2, is configured such that when the surface temperature of the ballast capacitor 3 is below approximately 0° C., the impedance of the ballast capacitor 3 decreases as the surface temperature of the ballast capacitor 3 decreases.

In other respects, the structure of the modified example of the first embodiment is similar to that in the above-described first embodiment.

Second Embodiment

Next, with reference to FIG. 6, a description will be given of the structure of a cold cathode tube lamp according to a second embodiment of the invention.

Figure 6:
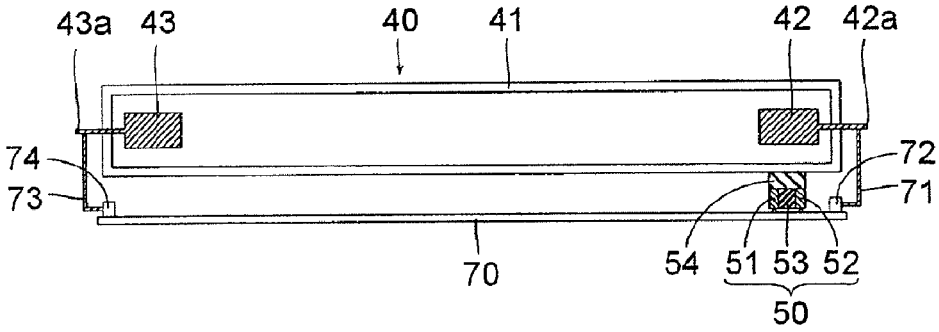
[FIG. 6] A schematic sectional view showing the structure of a cold cathode tube lamp according to a second embodiment of the invention.

A discharge tube 40 of the cold cathode tube lamp according to the second embodiment is, as shown in FIG. 6, structured like the discharge tube 1 of the above-described first embodiment. That is, the discharge tube 40 of the second embodiment includes a sealed tubular glass tube (insulating tube) 41 and a pair of electrodes 42 and 43 provided inside the glass tube 41, and is driven by being supplied with a voltage containing an AC component. The electrodes 42 and 43 are disposed in one and the other end parts, respectively, of the glass tube 41. The electrodes 42 and 43 have leads 42*a* and 43*a*, respectively, that penetrate and protrude from the side end parts of the glass tube 41. The lead 42*a* of one electrode 42 is connected to an inverter board 70 via a predetermined electric wire 71 and a connector 72. The lead 43*a* of the other electrode 43 is connected to the inverter board 70 via a predetermined electric wire 73 and a connector 74. Note that the inverter board 70 is one example of a "circuit board" according to the invention.

In the second embodiment, a ballast capacitor 50 mounted on the inverter board 70 is disposed in the vicinity of one end part of the discharge tube 40. This ballast capacitor 50 is composed of electrodes 51 and 52 made of silver and a dielectric layer 53 interposed between the electrodes 51 and 52. The ballast capacitor 50 is connected electrically to one electrode 42 of the discharge tube 40. Power is supplied to one electrode 42 of the discharge tube 40 via the ballast capacitor 50. Between the ballast capacitor 50 and the discharge tube 40 (glass tube 41), a heat-conductive member 54 made of silicone resin ("Sarcon GTR-30T" or "Sarcon TR-30T" manufactured by Fuji Polymer Industries Corporation, Limited, Japan) is so disposed as to make contact with the surfaces of the ballast capacitor 50 and the discharge tube 40 (glass tube 41). In the second embodiment, with the structure described above, the ballast capacitor 50 is in thermal contact with the discharge tube 40 indirectly via the heat-conductive member 54.

In the second embodiment, the dielectric layer 53 of the ballast capacitor 50 is made of a material based on strontium titanate. By forming the dielectric layer 53 of the ballast capacitor 50 from the material just mentioned, like the ballast capacitor 2 of the above-described first embodiment, when the surface temperature of the ballast capacitor 50 is below approximately 0° C., the impedance of the ballast capacitor 50 decreases as the surface temperature of the ballast capacitor 50 decreases.

In the second embodiment, by keeping the ballast capacitor 50, connected to one electrode 42 of the discharge tube 40, in thermal contact with the discharge tube 40 as described above, as in the above-described first embodiment, it is possible to light the cold cathode tube lamp easily when the ambient temperature around the discharge tube 40 is low.

In the second embodiment, by disposing the heat-conductive member 54 between the discharge tube 40 and the ballast capacitor 50 and keeping the ballast capacitor 50 in thermal contact with the discharge tube 40 indirectly via the heat-conductive member 54, it is possible to increase the capacitance (i.e. to reduce the impedance) of the ballast capacitor 50 as the ambient temperature around the discharge tube 40 decreases even when the ballast capacitor 50 is not in direct thermal contact with the discharge tube 40. Moreover, with the above configuration, because there is no need to provide the ballast capacitor 50 integrally with the discharge tube 40, the discharge tube 40 can be replaced solely.

In the second embodiment, by mounting the ballast capacitor 50 on the inverter board 70 as describe above, it is possible to hold the ballast capacitor 50 easily with the inverter board 70 when the ballast capacitor 50 is not provided integrally with the discharge tube 40. Moreover, it is possible to stabilize the electrical connection between the ballast capacitor 50 and the inverter board 70.

Next, with reference to FIG. 7, a description will be given of a cold cathode tube lamp according to a modified example of the second embodiment.

Figure 7:
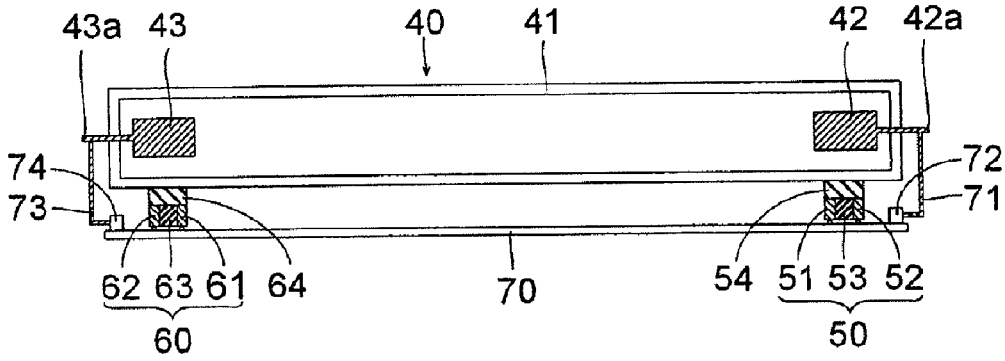
[FIG. 7] A schematic sectional view showing the structure of a cold cathode tube lamp according to a modified example of the second embodiment.
Figure 8:
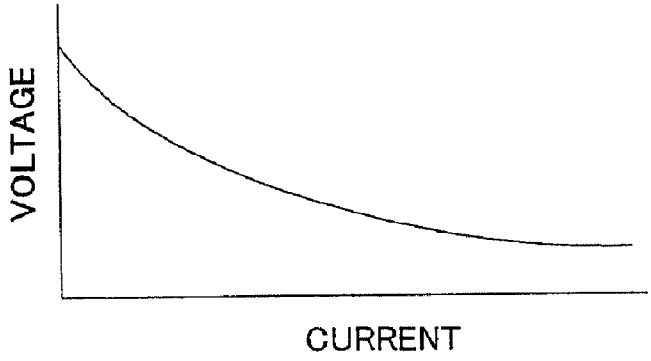
[FIG. 8] A diagram illustrating the characteristic of a cold cathode tube lamp.
Figure 9:
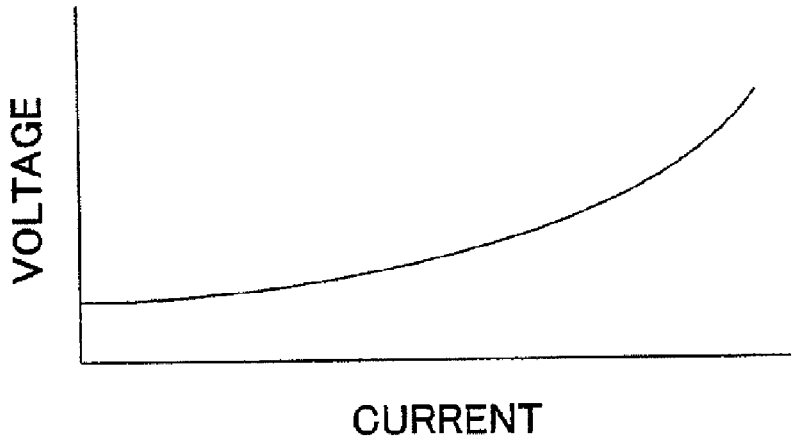
[FIG. 9] A diagram illustrating the characteristic of a cold cathode tube lamp in which a ballast capacitor is connected to a discharge tube.

As shown in FIG. 7, compared with the cold cathode tube lamp of the above-described second embodiment, that according to the modified example of the second embodiment differs in that in addition to the ballast capacitor 50 disposed in the vicinity of one end part of the discharge tube 40, a ballast capacitor 60 is further provided in the vicinity of the other end part of the discharge tube 40. This ballast capacitor 60, like the ballast capacitor 50, is composed of electrodes 61 and 62 and a dielectric layer 63, and is mounted on an inverter board 70. In the modified example of the second embodiment, power is supplied to the other electrode 43 of the discharge tube 40 via the ballast capacitor 60.

The ballast capacitor 60, like the ballast capacitor 50, is so configured as to be in thermal contact with the discharge tube 40 indirectly via a heat-conductive member 64. Moreover, the ballast capacitor 60, like the ballast capacitor 50, is configured such that its impedance decreases as its surface temperature decreases, when the surface temperature of the ballast capacitor 60 is below approximately 0° C.

In other respects, the structure of the modified example of the second embodiment is similar to that in the above-described second embodiment.

The embodiments disclosed herein are to be considered in all respects as illustrative and not restrictive. The scope of the present invention is set out in the appended claims and not in the description of the embodiments hereinabove, and includes any variations and modifications within the sense and scope equivalent to those of the claims.

For example, although the above-described first and second embodiments deal with an example in which a material based on strontium titanate is used to form a dielectric layer of a ballast capacitor, this is not meant to limit the invention; it is also possible, instead, to use any material other than one based on strontium titanate to form a dielectric layer of a ballast capacitor. For example, $BaO—Al_2O_3—SiO_2—Bi_2O_3$ (with a relative dielectric constant of approximately 7 and a dielectric constant temperature coefficient of approximately −30 ppm/K) may be used.

Although the above-described first and second embodiments deal with an example in which a glass tube is employed as a component for a discharge tube, this is not meant to limit the invention; it is also possible, instead, to employ an insulating tube other than a glass tube. For example, a tube made of a resin material that transmits light may be employed.

Although the above-described second embodiment deal with an example in which a heat-conductive member made of silicone resin is used, this is not meant to limit the invention; it is also possible, instead, to use a heat-conductive member made of any material other than silicone resin. It is preferable that the heat conductivity approximately per square meter ($m^2$) of the heat-conductive member be approximately $2\times10^3$ $W/(m^2\cdot K)$ or more.

The invention claimed is:

1. A cold cathode tube lamp comprising:

a discharge tube having a pair of electrodes and a tubular insulating tube inside which the pair of electrodes are provided, the discharge tube being driven by being supplied with a voltage containing an AC component; and a ballast capacitor connected to at least one of the pair of electrodes of the discharge tube, wherein the ballast capacitor is arranged on a circumferential surface of the tubular insulating tube of the discharge tube, is in thermal contact with the circumferential surface of the tubular insulating tube of the discharge tube and is configured such that a capacitance of the ballast capacitor increases as a surface temperature of the ballast capacitor decreases.

2. The cold cathode tube lamp according to claim 1, wherein at least part of the ballast capacitor is in direct thermal contact with the circumferential surface of the tubular insulating tube of the discharge tube.

3. The cold cathode tube lamp according to claim 2, wherein the ballast capacitor is provided integrally with the circumferential surface of the tubular insulating tube of the discharge tube.

4. The cold cathode tube lamp according to claim 3, wherein the ballast capacitor includes a conductive layer and a dielectric layer, and wherein the conductive layer and the dielectric layer are provided integrally with the circumferential surface of the tubular insulating tube of the discharge tube by being directly applied on a surface of the discharge tube.

5. The cold cathode tube lamp according to claim 1, further comprising:

a heat-conductive member disposed between the discharge tube and the ballast capacitor, the heat-conductive member being a member separate from the discharge tube, wherein the ballast capacitor is in thermal contact with the discharge tube indirectly via the heat-conductive member, and wherein the heat-conductive member is in direct contact with the ballast capacitor, and is in direct contact with the circumferential surface of the tubular insulating tube of the discharge tube.

6. The cold cathode tube lamp according to claim 5, further comprising:

a circuit board on which the ballast capacitor is mounted.

* * * * *